US005195280A

United States Patent [19]

Nicholson et al.

[11] Patent Number: 5,195,280

[45] Date of Patent: Mar. 23, 1993

[54] ABRASIVE BLASTING APPARATUS

[75] Inventors: Bruce Nicholson, Knaresborough; Ronald Davis, Bradford, both of United Kingdom

[73] Assignee: Gagemarch Limited, Knaresborough, United Kingdom

[21] Appl. No.: 917,785

[22] Filed: Jul. 20, 1992

Related U.S. Application Data

[63] Continuation of Ser. No. 411,509, Apr. 12, 1991, abandoned.

[30] Foreign Application Priority Data

Apr. 9, 1987 [GB] United Kingdom ..... 8708499

[51] Int. Cl.[5] ..... B24C 7/00; B24C 9/00

[52] U.S. Cl. ..... 51/436; 51/438

[58] Field of Search ..... 51/410, 436, 437, 438, 51/319, 320, 321, 322

[56] References Cited

U.S. PATENT DOCUMENTS

| | | | |
|---|---|---|---|
| 2,389,616 | 11/1945 | Franklin . | |
| 2,475,215 | 7/1949 | Barker | 51/436 |
| 2,942,860 | 6/1960 | Ridley et al. . | |
| 3,021,646 | 2/1962 | Williams | 51/436 |
| 3,091,369 | 5/1963 | Sackett | 51/437 |
| 3,266,193 | 8/1966 | McCune | 51/436 |
| 4,075,789 | 2/1978 | Dremann | 51/436 |
| 4,330,968 | 5/1982 | Kobayashi | 51/436 |
| 4,655,847 | 4/1987 | Ichinoseki | 51/410 |

FOREIGN PATENT DOCUMENTS

| | | | |
|---|---|---|---|
| 184027 | 2/1905 | Fed. Rep. of Germany . | |
| 2724318 | 11/1978 | Fed. Rep. of Germany | 51/437 |
| 370068 | 9/1906 | France | 51/436 |
| 389216 | 6/1907 | France . | |
| 1080033 | 12/1954 | France . | |
| 1198333 | 6/1958 | France | 51/436 |
| WO86/04290 | 7/1986 | PCT Int'l Appl. . | |
| 359766-A | 9/1973 | Sweden . | |
| 863694-A | 9/1986 | Sweden . | |
| 160060-A | 10/1986 | Sweden . | |
| 202922 | 2/1939 | Switzerland . | |
| 1394483 | 5/1975 | United Kingdom . | |
| 2171624 | 9/1988 | United Kingdom . | |

*Primary Examiner*—Bruce M. Kisliuk
*Assistant Examiner*—John A. Marlott
*Attorney, Agent, or Firm*—Arnold, White & Durkee

[57] ABSTRACT

A apparatus for mixing separately contained media such as would be used in a wet abrasive blasting operation comprises a receptacle (10) for a liquid/abrasive medium, a receptacle (11) for a liquid, and a delivery line (20) along which pressurized fluid is adapted to be fed. The receptacles (10,11) communicate via pipes (22,23) with the delivery line (20) so that the liquid and the liquid/abrasive medium are entrained by the pressurized fluid. The receptacles communicate with each other via a hole (14) to balance the fluid pressure system between them and a means (15,19) is also provided to deliver pressurized fluid into at least one of the receptacles (10,11) in order to substantially balance the fluid pressure system between the receptacles (10,11) and the delivery line (20) and to facilitate outflow of the liquid-/abrasive medium and the liquid into the entraining fluid.

12 Claims, 1 Drawing Sheet

ABRASIVE BLASTING APPARATUS

Figure 1:
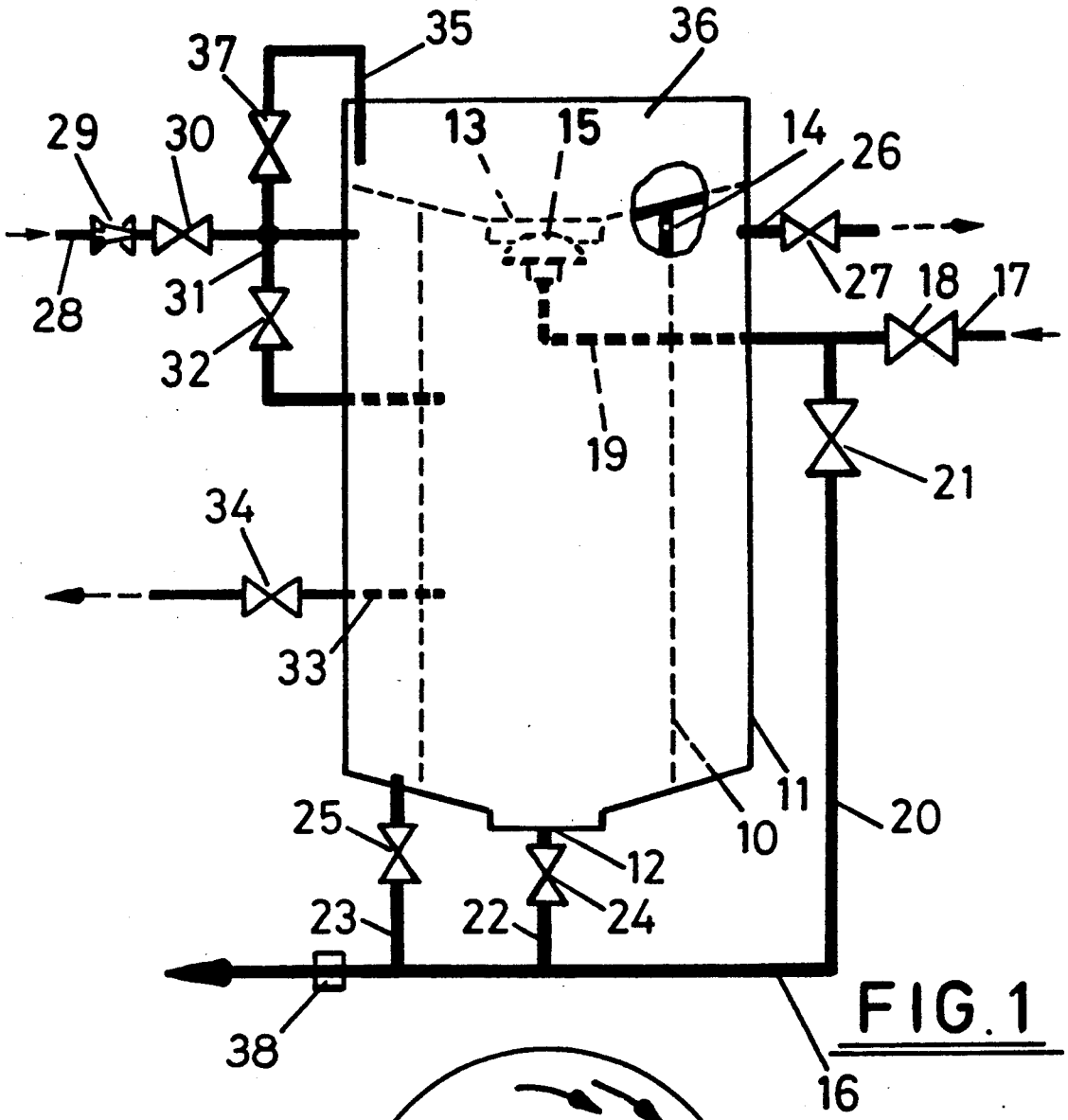

This application is a continuation of application Ser. No. 411,509, filed Apr. 12, 1991, now abandoned.

This invention relates to abrasive blasting apparatus especially but not exclusively a wet abrasive blasting apparatus.

In wet abrasive blasting apparatus the abrasive medium is entrained in a pressurized liquid flow or gaseous-entrained liquid flow (hereinafter for convenience simply referred to as "pressurized fluid flow") and is directed against the surface or other article to be treated by a controllable nozzle. It is common practice with such an apparatus to add a dry abrasive medium into a gaseous stream and then to add liquid to wet the abrasive medium prior to its egress from the nozzle outlet so that dust generation at the work area is reduced.

This liquid is normally delivered into the abrasive and pressurized fluid flow by a separate pump the inclusion of which makes the cost of the blasting apparatus more expensive than is desirable, renders the blasting apparatus more prone to breakdown, and requires a greater technical knowledge of the operator. A further disadvantage is that variations in the entraining fluid pressure require either manual adjustments of the pressure outflow from the pump, or the provision of a pressure balancing control means between the entraining fluid supply and the pump.

As a result, control of the apparatus with particular reference to the abrasive medium/liquid outflow is difficult, in the first instance, with consequent variation in the efficiency of the apparatus, and, in the second instance, the cost of the apparatus is further increased by the need to provide the pressure balancing control means which, in any case, does not provide instantaneous adjustment of the pump upon variations in entraining fluid pressure occurring, again with adverse effects on the efficiency of the apparatus.

It is an object of the present invention to provide an apparatus for wet abrasive blasting which obviates or mitigates the aforesaid disadvantages of cost, varying control and efficiency.

The apparatus according to this invention may be used dry, or the apparatus may, more generally, be employed for purposes other than abrasive blasting. More detailed references to these alternative uses will be made later.

Generally, therefore, apparatus according to the present invention comprises a first receptacle adapted to contain particulate material or a particulate material and a liquid combination, a second receptacle to contain material to be mixed with the contents of the first receptacle, and a delivery line along which an entraining pressurized fluid can be fed from a source and with which the receptacles are adapted to communicate, and is characterized in that a means is provided to direct pressurized fluid from the source into one of the receptacles behind its contents in terms of its contents outflow from the receptacle, and in that a communication exists between the receptacles substantially to balance the fluid pressure between the receptacles themselves and the receptacles and the delivery line to facilitate the simultaneous outflowing and dispersal of the contents of both of the receptacles into the entraining fluid flowing along the delivery line.

Preferably, the first and second receptacles are located one within the other.

Preferably also, the inlet in the first receptacle for the introduction of the particulate material or the particulate material and liquid combination is provided with a valve which is closed by the application thereto of pressurized fluid from within the receptacle.

Preferably also, a means to enable a circumferentially directed jet of liquid is provided to swirl the particulate material to assist its entry into the first receptacle.

Preferably also, the first and second receptacles are separated by a porous wall.

Also according to the present invention there is provided a method of mixing a plurality of separately contained media, at least one of which is a particulate material or a particulate material and a liquid combination, by entraining the media from their containers into a flow of pressurized fluid and characterized in that the pressurized fluid is simultaneously applied behind at least one of the media in terms of its outflow from its container, and in that a communication is provided between the containers substantially to balance the fluid pressure system between the containers themselves and the containers and the flow of pressurized fluid to facilitate the simultaneous outflowing and dispersal of the media from their containers into the entraining fluid.

The present invention can, therefore, provide a pumpless wet abrasive blasting apparatus and as the entraining pressurized fluid is also applied in this instance directly to an abrasive and a liquid combination and a separate liquid there is instantaneous and equal adjustment to the entraining pressurized fluid and direct pressurized fluid upon any pressure variations occurring at the pressurized fluid source.

Figure 2:
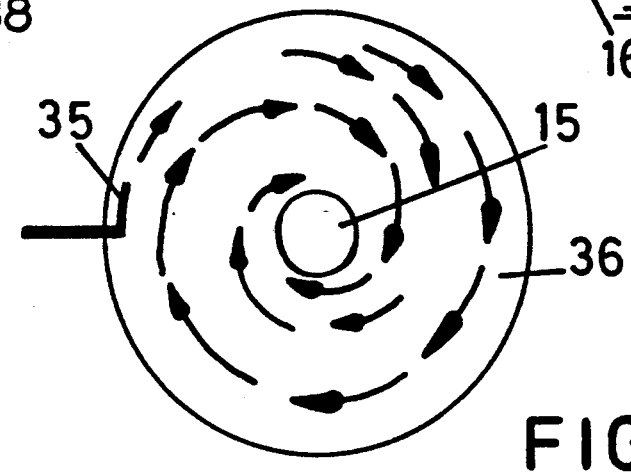

An embodiment of the present invention will now be described, by way of example, with reference to the accompanying drawing, in which:

FIG. 1 is a part sectional elevation of an apparatus for wet abrasive blasting according to the present invention; and FIG. 2 is a corresponding plan view.

The apparatus comprises two co-axial concentric receptacles or chambers 10 and 11. The inner chamber 10 serves to contain the abrasive medium which is for example sand, which sand may be wet sand. With the present invention it is not necessary as is customary with wet abrasive blasting apparatus using sand as the abrasive medium to employ dry sand which is often delivered to the apparatus bagged. As a consequence the present invention provides a wet abrasive blasting apparatus in which it is possible to re-use wet sand. The inner chamber 10 in use also, of course, contains water and it is to be noted that the water is always introduced first into the inner chamber 10 followed by the sand (or other solid abrasive medium) to ensure that there is effective mixing of the sand and water and no clogging at the outlet 12 of the inner chamber. The introduction of the sand into the water in the inner chamber 10 causes the sand to sink through the water thus getting wet immediately. The introduction of pressurized air into the inner chamber 10, as hereafter described, causes a swirling action in the inner chamber 10 to complete the mixing. The outlet 12 is disposed at the bottom of the chamber 10 and the inlet 13 of the inner chamber 10 is provided at the top of same.

The outer chamber 11, in use, contains additional water for addition to the sand/water mixture egressing from the inner chamber 10 as will be described later.

There is at least one hole 14 providing a communication between the outer chamber 11 and the inner chamber 10, which hole 14 is disposed at the upper end of both chambers 10, 11.

The inlet 13 to the inner chamber 10 is controlled by an air lock valve, for example a mushroom-type valve, 15, which valve 15 is closed on application thereto of pressurized air.

The apparatus has as its operational or motive fluid pressurized air which passes from a pressurized air source, such for example as a pressurized air mains (not shown) to a delivery pipe system generally indicated at 16.

Air under pressure is delivered from a source (not shown), possibly an air compressor to the pipe system 16 at the main inlet 17 controlled by a valve 18.

Pressurized air is delivered to the valve 15 by a pipe 19, which air then flows from the inner chamber 10 into the outer chamber 11 via the hole 14.

Pressurized air is also delivered by a pipe 20, valve controlled as indicated at 21 to an abrasive blasting hose and nozzle (not shown) coupled to the pipe 20 by a bayonet joint connection as indicated at 38. The nozzle of the abrasive blasting hose is provided with a deadman's handle so that the abrasive blasting operation is controlled by the operator (release of the handle closing the nozzle and discontinuing the abrasive blasting operation).

Preferably the blasting nozzle is of the lance type and not a conventional venturi nozzle as it has been found that abrasive tends to lodge in and clog a venturi nozzle during use of the apparatus. The lance provides an outflow for the pressurized fluid which has a smaller n bore than that of the delivery pipe 20 effectively to concentrate the pressurized fluid flow therethrough so that it can be appropriately directed by the operator. It has been found that the lance operates effectively when the ratio of the diameters of the pipe 20 and of the lance is in the range 1.5:1 to 10:1 inclusive with a lance that is at least 100 mm in length. Typically, the diameter of the bore of the lance is of the order of 15 mm for a 45 mm diameter pipe 20 for delivery of pressurized air at 10 cubic meters per minute at 100 psi. The length of the lance is usually of the order of 450 mm to enable the operator to distance himself from the blasting and grip the lance effectively.

The chambers 10 and 11 communicate with the pipe 20 via pipes 22 and 23 respectively each of which is respectively controlled by a valve 24, 25.

Thus the pipes 22, 23 provide communication between the bottom of the chamber 10 and 11 with the pipe 20.

Adjacent the top of the outer chamber 11 there is provided a fast exhaust pipe 26 controlled by a valve 27.

Water is supplied to the inner and outer chambers from for example a mains water supply (not shown) by a pipe 28 incorporating a non-return valve 29 and an open/close valve 30. The water is delivered directly into the chamber 11 by the pipe 28 to which is connected a pipe 31 for delivering water into the inner chamber 10, this pipe being valve controlled as indicated at 32.

A water level control or overflow pipe 33 communicates with the inner chamber 10, this pipe 33 also being valve controlled as indicated at 34.

The various valves are indicated as being manually controlled but it is clearly to be understood that these valves can be subject to automatic control in any convenient manner.

To render the apparatus ready for use the valves 18, 21, 24, 25, 27, 30, 32 and 34 are all closed. Valves 30 and 32 are then opened to allow water to flow into the inner and outer chambers 10, 11. A given quantity of abrasive medium for example sand (wet or dry) is then fed through the inlet 13 which is open owing to no air pressure being supplied to the valve 15 to close same. Water continues to be fed into the chambers 10 and 11, and, when the required total volume of sand and water is delivered into the inner chamber 10, water will flow out of the pipe 33. At this stage, the valve 32 is closed followed by the valve 34. When sufficient water has been fed into the chamber 11, the valve 30 is also closed.

The valve 17 is then opened causing the valve 15 to be moved to the closed position and pressurized air to be introduced into the inner chamber and, through the communication hole 14, into the outer chamber 11.

Valve 21 is now opened allowing pressurized air to flow along the pipe towards the hose and nozzle (not shown). Valves 24 and 25 are then opened to the desired degree to allow the water/sand mixture from the chamber 10 and additional water from the chamber 11 to be moved into, and be entrained by, the airstream for delivery along the hose out of the nozzle whence it is directed against the surface or other article to be abrasive blasted.

The sand/water mixture and the additional water are subjected to the same air pressure in the upper part of the chambers 10 and 11 as that which is used to entrain them out of their respective chambers.

Thus, any variation in the air pressure at source is automatically and instantaneously applied to both the entraining air and the internal air contained within the chambers 10 and 11.

At any stage, the valve 24 can be closed, and water only from the chamber 11 be fed into the airstream, for the purposes of washing down the work area.

Alternatively, the valves 24 and 25 can be closed leaving air travelling through the hose and nozzle, for blowing or drying purposes.

During operation, the air feed pressure can be varied up or down in order to achieve different rates of working or different types or levels of finish on the work area. A pressure gauge may, in these circumstances, be included in the air inlet line 17 in order that the operator can more accurately judge the working pressure.

The normal sequence of operations for shutting off the apparatus is first of all to close the valve 24 to prevent any further emission of abrasive. When all of the abrasive in the hose has cleared, the valve 25 may be closed to prevent any further water going down the line. After all the water has cleared from the hose, the valves 21 and 18 are closed. The valve 27 may then be opened to allow fast reduction of the air pressure in vessels 10 and 11, which in turn allows air lock valve 15 to open.

If, for any reason during normal operation, an emergency stop is required, this can be activated manually, or triggered automatically (by release of the deadman's handle, for example), by opening the valve 27, preferably with a simultaneous closure of the valve 18.

Means is provided to effect fast filling of the chamber 10 with substances which do not flow quickly on their own (e.f. wet sand or slurry). Such means consists of a water jet 35 situated inside and in close proximity to the wall of the filling hopper 36 at the top of the apparatus. The jet 35 is circumferentially-directed that is swirls water round the hopper area, when required, and enables the entry of the material through the open inlet 13 and into the chamber 10. A valve 37 controls the flow of water to the jet 35.

It is to be noted that additives can be included in either the water in the chamber 10, or alternatively, in the water in the chamber 11, such an additive being, for example, a rust inhibitor if the surface or article being treated is formed of metal, or an anti-freeze material for low temperature working. Alternatively, the additive may be introduced in powder or granular form, mixed with the abrasive. Because the total volume of material in both chambers is known at commencement of the operational sequence, pre-measured doses of additive can be included in either chamber to give an accurate dilution of the additive.

The wet abrasive blasting apparatus described above can be used dry and in this case the dry abrasive or other abrasive medium is simply contained within the chamber 10, the water supply system being closed off and the sand or other abrasive medium being entrained along pipe 20 through the pipe 22 via the open valve 24, the sand being subjected to the internal air pressure equal to the entraining air pressure as described above.

The apparatus can also be used for ice blasting and in this case the inner chamber will contain ice particles and water and the outer chamber 11 will contain water. It is to be noted that the ice particles formed from water will be prevented from coagulating (freezing together) by introducing suitable additives into the water prior to freezing. Suitable additives would be for example polyphosphates.

The above described apparatus can, as aforesaid, be used either wet or dry as described and it can be used for washing down using water only from chamber 10 or even from chambers 10 and 11.

The apparatus provides faster cleaning than known wet abrasive blasting apparatus (all other operational factors being equal). It can be up to 20% faster or even more in certain circumstances. The reason for this is that each particle of abrasive, having being soaked under pressure, is enclosed in a film of water so that its effective weight is increased as it leaves the blast nozzle. Thus its momentum is greater and it does more work when it strikes the workpiece surface.

The apparatus is not subject to "choking" as are known apparatus which, on occasion, become blocked at the abrasive outlet of the pressure vessel. In practice, with the known apparatus, these blockages are usually relieved by turning off the main air supply (e.g. closing valve 21) momentarily.

The apparatus is relatively cheap to manufacture compared with known apparatus.

There is less wastage of abrasive on site since with the apparatus according to the present invention all spent abrasive can be re-used in the wet condition i.e. it is not necessary to dry same.

The apparatus can be readily used in high humidity areas since contamination by moisture will not adversely affect it.

The apparatus is spark free and static free. It is pumpless as will be clear from the above and due to the lack of pump there is obviously no need to provide a pump driving generator.

The apparatus has no mechanical working parts and due to the simple nature of the apparatus all parts can easily be changed and renewed in a short time.

The apparatus is safe to use and as a result can be used by unskilled labour.

The apparatus, when used in a wet-blasting process, produces far less air-borne dust than comparable known apparatus, and therefore far less fall-out at any given distance from the work area. This makes it environmentally more acceptable.

Finally, the apparatus can be used with a wide range of easily obtainable abrasives wet and dry and in use it is considered that there will be a lower usage of abrasive than with other wet abrasive blasting systems (in the region of 20% less) and the apparatus involves less clearing up on site than conventional wet abrasive blasting apparatus.

The apparatus according to the present invention is extremely versatile and can be used, inter alia, as follows:

1. Wet or dry abrasive cleaning of stone, brick, terracotta, steel, iron, and all other hard or semi-hard surfaces.

2. Stripping of paints and other coatings from these surfaces, either in one operation or layer by layer.

3. Washing off of these surfaces.

4. Removal of contaminants from surfaces, e.g. radioactive contamination or biological contamination (possibly using chemical additives in the water to improve the efficiency of the treatment); removal of oils and greases from surfaces (possibly using hot water, or solvents in place of water, to speed removal).

5. Removal of graffiti from stone and other surfaces.

6. Texturing of surfaces either for aesthetic appearance or as a preparation for over coating or bonding of the surface; the exposing of grain on timber surfaces; the 'frosting' of glass to make it opaque; the roughening or matting of plastic and all other surfaces.

7. Engraving of glass, stone, plastic, and other surfaces, using suitable masks where appropriate.

8. Mixing of materials, dilution of mixes, and spray application of materials, the mixing of substances in one or more forms (such as solids in powder, granular or fibrous form, or semi-solid materials, or liquids) with themselves or with each other, and the spray or 'blast' application of the resultant mixes. For example, the mixing and application of renders, slurries, coatings, paints, adhesives, deicing mixes (e.g. mixing salt with sand or gravel and spraying onto roads liable to freezing, or deicing mixes onto aircraft), the mixing of plant seeds into culture media and the spray application of such; the mixing and spraying of fertilizers and weedkillers onto agricultural land; the mixing of or coating of textile fibres with bonding agents and their spray application in, for example, bonded fabric production; the impregnation of surfaces with another substance; the variegated colouring of surfaces such as floors, walls, tiles, by using different coloured materials in the different chambers or of different densities on one chamber.

Modifications may be made to the above described apparatus.

For example a porous wall may be provided between the chambers 10, 11 in order to allow for the movement of, say, a liquid from chamber 11 into chamber 10. For example, when ice blasting, ice and water would be put into chamber 10, and water into chamber 11. If the water in chamber 10 is reduced too much during the blasting operation, then water can percolate from chamber 11 to chamber 10 and so prevent clogging of the ice in chamber 10.

In another embodiment of the invention, an outer chamber is used for the abrasive/liquid medium and an inner chamber for the liquid medium. Here, the inner chamber can be of a small volume with respect to the outer chamber and a porous wall can be used to divide the chambers so that the liquid flows from the outer chamber into the inner chamber to charge it with liquid prior to and during the blasting to obviate the need for separate pipework and other filling means. Some of the abrasive may also pass into the inner chamber through the wall but this does not inhibit the mixing and blasting process. However, this is preferably prevented by making the pore size in the wall such that passage of the abrasive therethrough is prevented. Effectively, in this embodiment the inner chamber is reduced to a porous pipe located in the outer chamber and communicating therewith above the level of the media contained therein, through which pipe liquid can be drawn off from the liquid/abrasive medium and entrained separately in the pressurized fluid from the abrasive/liquid medium.

The apparatus may comprise more than two chambers provided all the chambers are in communication so that there is in the chambers air pressure equal to the entraining fluid pressure.

The chambers may be located one within the other and be coaxial and concentric as in the above described apparatus or they may be disposed in side-by-side relationship either parallel one with another or in juxtaposed coaxial relationship.

The chambers may in fact be separate one from another and there may be two or more chambers provided there is communication between them to ensure common fluid pressure within all the chambers, which pressure is equal to and variable with the entraining fluid pressure.

We claim:

1. An abrasive blasting apparatus comprising:

a first receptacle adapted to contain a particulate material or a particulate material and a liquid combination and including an inlet and a bottom outlet;

a second receptacle to contain material to be mixed with the contents of the first receptacle and also including an inlet and a bottom outlet;

a delivery line in communication with the respective bottom outlet of each of the first and second receptacles;

a source of pressurized fluid connected to the delivery line;

means connecting the source of pressurized fluid with the interior of one of the receptacles and capable of directing pressurized fluid into said one receptacle behind the receptacle's contents in terms of the outflow of said contents from the receptacle through the bottom outlet; and communication means between the interiors of the first and second receptacles to substantially balance the fluid pressure both between the interiors of the receptacles and between the interiors of the receptacles and the delivery line to facilitate simultaneous outflowing of the contents of the first and second receptacles through their respective outlets into the entraining fluid flowing along the delivery line.

2. An apparatus as claimed in claim 1, wherein: the first and second receptacles are located one within the other.

3. An apparatus as claimed in claim 2, wherein:

the first and second receptacles are separated by a porous wall.

4. An apparatus as claimed in claim 3, wherein:

the outer receptacle comprises the first receptacle which is adapted to contain a particulate material and a liquid combination, and the inner receptacle comprises the second receptacle which is adapted to contain a liquid, the inlet of the second receptacle comprising the porous wall through which liquid can pass into the second receptacle from the first receptacle.

5. An apparatus as claimed in claim 1, further comprising:

a valve provided at the inlet of the first receptacle for the introduction of the particulate material or the particulate material and the liquid combination thereto, said valve being closable by the application thereto of pressurized fluid from within the first receptacle.

6. An apparatus as claimed in claim 1, further comprising:

means to enable a circumferentially directed jet of liquid to swirl the particulate material to assist its entry into the first receptacle through the inlet.

7. An apparatus as claimed in claim 1, further comprising:

a lance provided at the end of the delivery line, the lance including a straight-bore rigid tube of at least 100 mm in length, the ratio of the diameters of the delivery line and of the lance being between 1.5:1.0 and 10:1 inclusive.

8. A method of mixing a plurality of separately contained media, at least one of which is a particulate material or a particulate material and a liquid combination, comprising the steps of:

providing first and second receptacles to contain said media;

providing a flow of pressurized fluid;

entraining the media from the first and second receptacles into the flow of pressurized fluid;

simultaneously applying the pressurized fluid behind at least one of the media in terms of said medium's outflow from said medium's receptacle; and providing a communication between the interiors of the first and second receptacles so that either the pressurized fluid or said at least one pressurized medium substantially balances the fluid pressure between the interiors of the first and second receptacles themselves and the interiors of the first and second receptacles and the flow of pressurized fluid to facilitate the simultaneous outflowing and dispersal of the media from the receptacles into the entraining pressurized fluid.

9. A method as claimed in claim 8, in which one of the media is a liquid with a temperature above the ambient temperature.

10. A method as claimed in claim 8, in which a porous wall is provided to separate the first and the second receptacles and in which the particulate material is ice.

11. An abrasive blasting apparatus using a mixture of two different blasting materials, comprising:

a first receptacle adapted to contain a particulate blasting material or a particulate blasting material and a liquid combination, the first receptacle having an outlet near the bottom of the first receptacle to allow the flow of blasting material out of the first receptacle principally by gravity;

a second receptacle adapted to contain a second blasting material that is different from the blasting material contained in the first receptacle and which second blasting material is to be mixed with the blasting material from the first receptacle, the second receptacle having an outlet near the bottom of the second receptacle to allow the flow of the second blasting material out of the second receptacle principally by gravity;

a delivery line in fluid communication with the outlet of the first receptacle and the outlet of the second receptacle; and, valve means interposed between the outlet of the first receptacle and the delivery line, and also between the outlet of the second receptacle and the delivery line, for controlling simultaneous outflowing of blasting material from both the first receptacle and the second receptacle, to allow the blasting material from the first receptacle to be mixed with the second blasting material from the second receptacle, to thereby yield a blasting jet having two different blasting materials therein;

means for developing a differential pressure between the first and second receptacles and the delivery line to assist in the egress of blasting material from the receptacles; and means in fluid communication with the first and second receptacles for substantially balancing pressures in the first receptacle and the second receptacle to facilitate the simultaneous outflowing of blasting material from the first and second receptacles.

12. An abrasive blasting apparatus using a mixture of two different blasting materials, comprising:

a first receptacle adapted to contain a particulate blasting material or a particulate blasting material and a liquid combination, the first receptacle having an outlet near the bottom of the first receptacle to allow the flow of blasting material out of the first receptacle principally by gravity;

a second receptacle adapted to contain a second blasting material that is different from the blasting material contained in the first receptacle and which second blasting material is to be mixed with the blasting material from the first receptacle, the second receptacle having an outlet near the bottom of the second receptacle to allow the flow of the second blasting material out of the second receptacle principally by gravity;

a delivery line in fluid communication with the outlet of the first receptacle and the outlet of the second receptacle; and, valve means interposed between the outlet of the first receptacle and the delivery line, and also between the outlet of the second receptacle and the delivery line, for controlling simultaneous outflowing of blasting material from both the first receptacle and the second receptacle, to allow the blasting material from the first receptacle to be mixed with the second blasting material from the second receptacle, to thereby yield a blasting jet having two different blasting materials therein;

means for developing a differential pressure between the first and second receptacles and the delivery line to assist in the egress of blasting material from the receptacles; and means in fluid communication with the first and second receptacles and the delivery line for substantially balancing the fluid pressure both between the inside of the first and second receptacles, and between the inside of the receptacles and the delivery line, to facilitate the simultaneous outflowing of blasting material from the first and second receptacles. 1

* * * * *